United States Patent [19]

Russell

[11] 4,253,661

[45] Mar. 3, 1981

[54] LEG EXERCISING DEVICE

[76] Inventor: Brian Russell, 11715 Kehough, Northglenn, Colo. 80233

[21] Appl. No.: 968,742

[22] Filed: Dec. 13, 1978

[51] Int. Cl.[3] ..... A63B 23/04

[52] U.S. Cl. ..... 272/96; 272/70

[58] Field of Search ..... 272/93, 69, 70, 96; 5/481, 464

[56] References Cited

U.S. PATENT DOCUMENTS

| | | | |
|---|---|---|---|
| 2,820,454 | 1/1958 | Wright | 272/96 X |
| 3,434,715 | 3/1969 | Brantingham | 272/96 |
| 3,627,313 | 12/1971 | Schonfeld | 272/69 |
| 3,634,895 | 1/1972 | Childers | 272/69 |
| 3,641,601 | 2/1972 | Sieg | 272/96 |
| 4,159,826 | 7/1979 | Hancock | 272/70 |

*Primary Examiner*—Richard J. Johnson

*Attorney, Agent, or Firm*—Richard D. Law

[57] ABSTRACT

Thick, resilient, flexible pad with a sloped top surface and sloped sides provides for safe, non-jarring leg exercises involving running, squatting, squat-running, leg joint pivoting, balance and the like.

3 Claims, 13 Drawing Figures

LEG EXERCISING DEVICE

THE INVENTION

This invention relates to leg exercising devices of a resilient, flexible, formed thick pad, having a sloped top and sloped sides.

A number of exercise devices have been available for legs, but usually with weights involved. These devices strengthen forward and rear muscles of the leg, that is, squats with weights strengthen front and rear thigh muscles, and leg lifts strengthen the calf. For a runner, jogging or actual running has been the exercise necessary to build strength and stamina.

Obviously, motion sports require strong legs. Unfortunately, legs are one of the first of the body systems to give out. Of particular weakness are the knees, as are the ankles. Running strengthens legs for a while, but continued pounding on hard surfaces has a disabling effect not only to the legs, but to the body's internal organs. Again, running aids muscles used in straight forward motion, but not side motions and side pivots of the legs. Running does not essentially strengthen the knees or ankles for lateral movement. Skating does strengthen the ankles, but few athletes can afford the time for a sufficient amount of skating. The knees are weakest in a side thrust, as is the dread of football and soccer players.

PRIOR ART

Several U.S. patents have issued for running or jogging exercises, and these include U.S. Pat. No. 3,641,601, issued Feb. 15, 1972 to Sieg. This device is a pad of thick framed rubber or plastic with a horizontal, parallel top and bottom. In one form, the device has a bifurcated top, one for each foot. The horizontal top surface maintains the foot is the same general angle (flat) as walking on the ground and does not change the action of the leg muscles of ordinary walking, jogging or running. Another foamed material pad is shown in U.S. Pat. No. 3,634,895 issued Jan. 18, 1972 to Childers. This unit includes a non-skid, essentially rigid top surface and a thin (1–2 inches) of foamed material. It provides a horizontal surface for the user. A similar pad is shown in U.S. Pat. No. 3,627,313 issued Dec. 14, 1971 to Schonfeld who incorporates a counter in the pad for counting jogs by the user. Thus, the horizontal surface devices provide exercise for the walking, jogging or running muscles, but fail to fully exercise ankle, knee, foot, etc. muscles.

OBJECTS AND ADVANTAGES OF THE INVENTION

Among the objects and advantages of the present invention is to provide an exercise device for essentially all lower limb muscles, particularly muscles not used in ordinary walking, jogging or running, and for the lower limb joints.

Another object of the invention is to provide an exercise device providing simulation of uphill or downhill motion with additional muscular resistance for enhanced exercise.

Yet another object of the invention is to provide an exercise device for user's ankles and knees having multiple positions for foot angle include forward and rear and sidewise exercises.

Still another object of the invention is to provide an exercise device for a user's legs which, also, exercises the user's balance.

A further object of the invention is to provide a leg exercise device for squatting leg exercises, having additional muscle resistance, multiple leg positions and balance during squat exercises.

An additional object of the invention is to provide a portable exercise device for lower limbs and joints.

These and other objects and advantages may be ascertained by reference to the following description and appended drawings.

GENERAL DESCRIPTION OF THE DRAWINGS

SPECIFIC DESCRIPTION OF THE DRAWINGS

Figure 1:
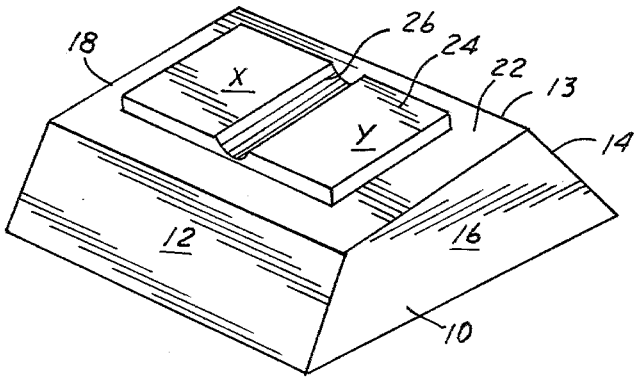
FIG. 1 is perspective view of one form of a leg exercise device incorporating an ankle exercising and strengthening top.
Figure 2:
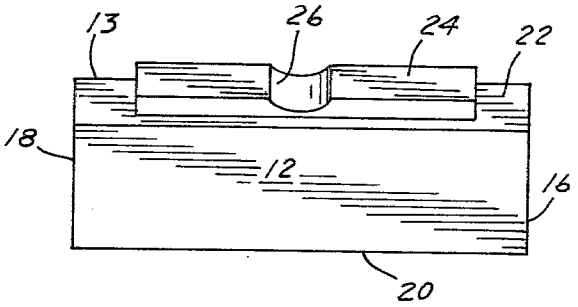
FIG. 2 is a front elevation of the form shown in FIG. 1.
Figure 3:
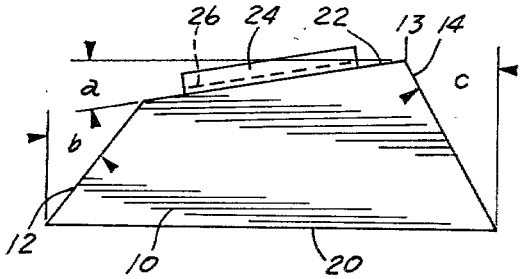
FIG. 3 is a side elevational view of the device of FIG. 1.

The device selected for illustration in FIGS. 1–3 includes a base member 10, having sloped front side 12 and sloped rear side 14. The other two sides 16 and 18 may be essentially vertical. The unit has a planar bottom side 20 and sloped top surface side 22. The top slopes from the top of the rear side 14 downwardly to top of side 12, when the bottom is horizontal, or positioned for resting on a horizontal floor or the like. A top portion 24 is secured generally centered on the top surface 22 leaving a ledge around the top portion. This ledge is preferably wide enough to accommodate at least about one half of a user's foot. A central, rounded slot 26 extends across the top portion 24 from front to rear, providing planar surfaces x and y.

The unit is made of a flexible resilient, foamed material which includes foamed plastics or synthetic resins, foamed rubber (generally preferred because of durability) etc. Such flexible plastic foams as polyurethane, polyvinyl, and like foams may be used, preferable covered to prevent damage and deterioriation of the foamed material.

In a highly useful size for adults and children, the base is about 24 inches square, and at least about 6 inches thick, (may be 6–9 inches thick) prior to attaching the sloped top portion so that the rear top edge 13 is at least about 6 inches thick, and the top portion 24 is at least about 1½ inches thick, leaving about 5 inches of top surface 22 exposed on a side. The top portion is about 12 inches from front to rear. The rounded groove 26 is about 1 inch in radius, but providing about ½ inch thickness of top portion below the groove. This provides a maximum height of the unit of about 7½ inches. The front side 12 is formed at an angle of from 20° to 40° from the vertical and the rear surface 14 is sloped toward the front side at from 15° to 35° from a vertical. A preferred form uses a front side at 35° from the vertical sloped toward the rear and a rear side at 30° from the vertical. (The front side is so designated to indicate an upwardly directed top surface, for convenience.)

The top surface 22 of the base 10 (and also the top surface of part 24) is sloped upwardly from the front to the back at from 5° to 40° from a horizontal, preferably at from 15° to 25°, to thereby position feet and legs in an up-hill position in one facing direction or a down-hill position in the other facing direction, without undue strain.

For use of the unit, the top surfaces of the top portion are designated X and Y for ease of discussion. In an up-hill position facing the top edge 13, a users left foot is placed on X and the right foot on Y. Walking or jogging is simulated by shifting weight and alternately lifting the legs. The weight of the user causes the foam material to depress and on lifting a leg the foam resumes its original configuration. By not removing a foot during lifting of the leg, the user must resist the rebound of the foamed material. This gives a double exercise, e.g. down and up. The up-hill position exercises the calf muscles as they are in tension during the exercise. By reversing the user's position to a toe down-hill position, the shin muscles are exercised. The foamed material, of course, takes up the shock of the walk or jog. By squatting and walking or jogging (in either up-hill or down-hill position) the thigh muscles are exercised as well as the other leg muscles. The ankles may be exercised by placing the feet almost together in the groove and the lower body rocked to shift weight and bend the ankles. Outward ankle bend is achieved by placing the feet on the outer edges of the top 24 with about one-half of the foot extending beyond the edge of the top 24. By rocking, the ankles are made to rotate outwardly, and base material contacting the outer edge of the foot adds resistance to movement. These exercises can be done in either up-hill or down-hill position to work all the muscles operating the ankle. The knees are worked with the feet in similar position, but with the user squatted so the legs can be rocked working the knees laterally. The toes may be turned pigeon-toed into the groove, providing another position for exercise.

The thick foamed material provides excellent resistance to walking, jogging and running, and permitting higher lifts of the legs than in actual running, without the feet leaving the material. The unit, also, is excellent training for skiers since it teaches balance as well as working the muscles. The sloped front and rear sides permits heel raises (toes on the unit) with increased resistance due to the flared out material. The vertical sides may, also, be sloped to increase resistance on depression of those sides.

Figure 4:
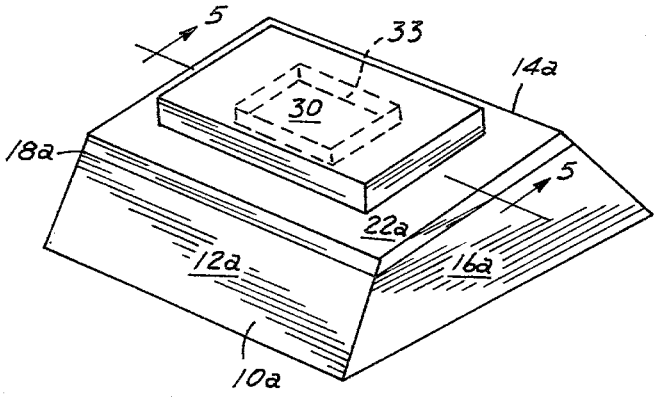
FIG. 4 is a perspective of a modified form of the invention.
Figure 5:
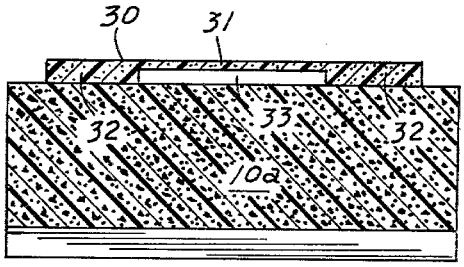
FIG. 5 is a cross-sectional detail of the device of FIG. 4.
Figure 6:
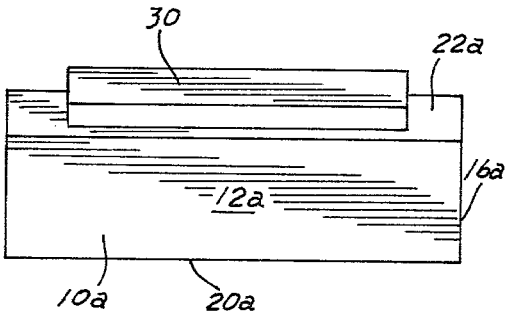
FIG. 6 is a front elevational view of the form shown in FIG. 4.
Figure 7:
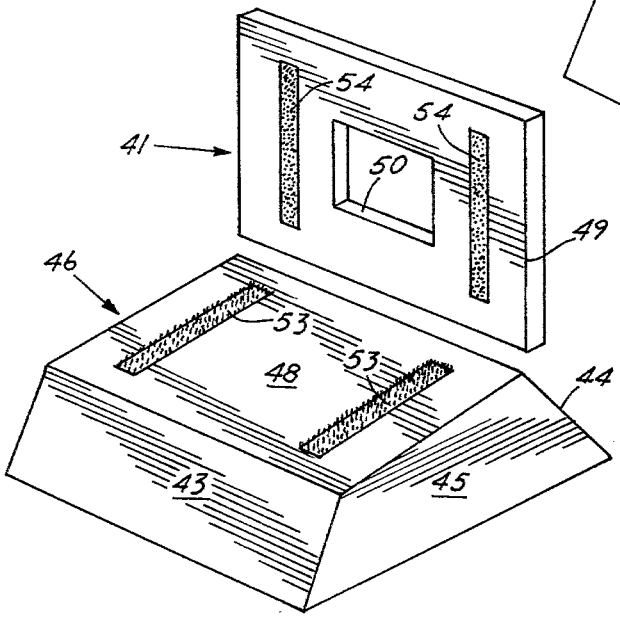
FIG. 7 is an exploded perspective view of another form of the invention showing the assembly of the parts.
Figure 10:
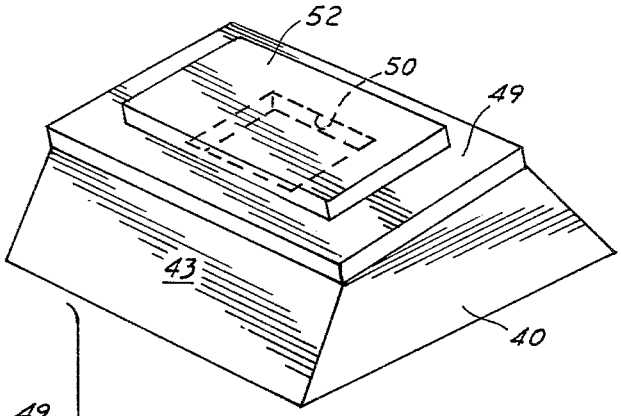
FIG. 10 is a perspective view of the assembled devices of FIGS. 7, 8 and 9.
Figure 11:
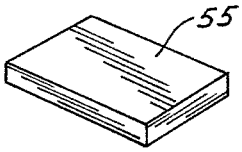
FIG. 11 is a perspective view of an insert for the top portion of the device of FIGS. 7, 8 and 10.
Figure 8:
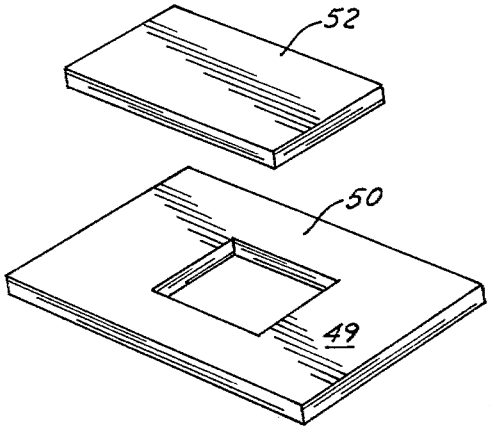
FIG. 8 is an exploded perspective view of the removable top portion of the device of FIG. 7.

A modified unit is shown in FIGS. 4–6. This unit has a base similar to the base of FIG. 1, including front and rear sides 12*a* and 14*a*, and sides 16*a* and 18*a*. The unit includes sloped top surface 22*a* and base or bottom side 20*a*. A top 30 is secured to the base generally centrally of the top surface 22*a*, leaving a ledge around it. The top 30 is secured by cementing, solvent or otherwise to the base (top 24 is likewise secured to base 10) so as to be securely attached. The top 30 is a rectangular member having a rectangular slab top portion 31 with a peripheral base 32, leaving a cut out 33. The width of the peripheral base of the top should be 3–5 inches permitting a foot to rest on its full width. In a useful form, the slab 30 is about 1 inch thick and the peripheral base 32 is about 1½ inches thick.

This unit is used similarly to the unit described above. The hollow permits the feet to be placed so the ankles may be rotated inwardly and at the edges to rotate the ankles outwardly. The feet may be positioned over the hollow with the toes on the edge of the hollow and the heels in the hollow, to give a different exercise.

The foamed material permits movements not available to an exerciser on a hard surface, and thus greatly expands the types of exercises that may be done, and adds new dimensions to the exercise of the legs, ankles and knees. The lateral rotational movements exercises the knees in lateral directions which cannot be done on hard surfaces.

The material may be covered by a resistant covering to prevent damage to the foamed material. Also, the covering may be removable for cleaning or replacing. The small size of the unit permits ready transportation, and its lightness adds to portability, making it very versatile for an exerciser. The softness of the foam material may be varied to suit the weight of the user, or as may be desirable by the manufacturer.

In a specific embodiment shown in FIGS. 7–11, a multiple use exerciser is shown. A base, shown generally by number 40, has separable a top member, shown generally by number 41. The base includes sloped front side 43 and sloped rear side 44, at angles generally specified for the device of FIG. 1. It has generally vertical sides 45 and 46. A sloped upper surface 48 extends between front 43 and rear 44. This upper surface is sloped as explained for the unit of FIG. 1. The base is planar for resting on a horizontal floor or the like.

The top member 41 includes a rectangular portion 49 with a general square cut out 50. A rectangular cover member 52 is centered and fastened to the member 49 over the opening 50. The rectangular portion 49 is releasably fastened to the base 40 by means of velcro fasteners (trademark) with strips of one-half of the fastener 53 secured to the base 40 on the upper surface 48. The other half of the fastener is secured to the rectangular portion 49 in position to secure to the other halves of the fastener. The base 40 may be covered with a cover (not shown) which may be removably mounted on the base, and the fastener half is sewed or otherwise fastened to the cover. The removable cover may be washable.

The base 40 may be made of sponge rubber of a relatively light density and the top members made of heavier density sponge rubber. In one form, the bottom is about 2 feet square and some 6 inches maximum thickness. The member 49 may be about 1 inch thick as is the top member 52. These may be varied some ¼ to 1 inch as suits the user. The member 49 with a cutout provides exercises for the feet, legs, ankles and knees for side motions as well as forward and reverse motions. For jogging motions, the cutout 50 may be filled by the cutout shape 55, FIG. 11, normally the portion cutout of the member 49. This gives a top without the excessively depressable portions for the ankle and knee exercises.

Figure 12:
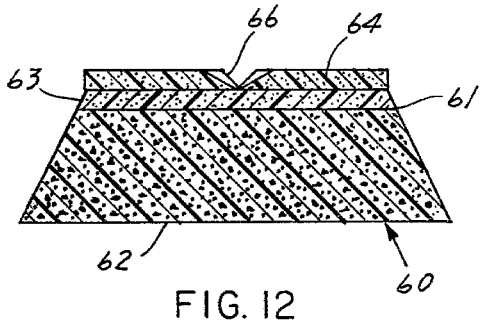
FIG. 12 is a side elevational view of a modified form of an exerciser according to the invention, particularly useful for exercising ankles and knees, sectioned to show different densities of materials, along section line 12—12 of FIG. 13.
Figure 13:
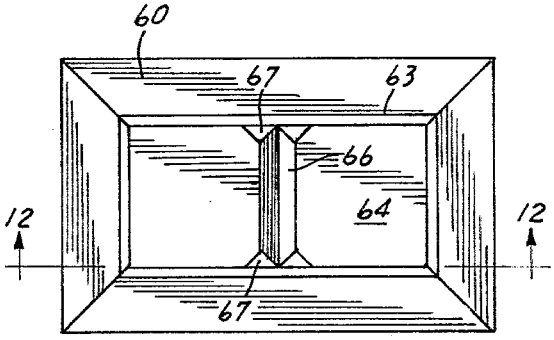
FIG. 13 is a top plan view of devices of FIG. 12.
Figure 9:
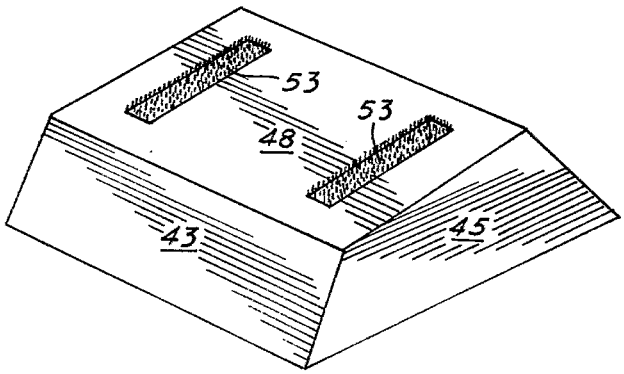
FIG. 9 is a perspective view of the base portion of the device shown in FIG. 7.

In another specific embodiment, a permanent V-shaped cut provides ankle exercises, FIGS. 12 and 13. This unit includes a base 60 of a light density foam with four sloped sides between a smaller top surface 61 and planar bottom surface 62. A rectangular first top member 63, with sloped sides to match the sloped sides of bottom 62, is secured to the top surface 61. A second top member 64 (about 1½ inches thick) of a heavier density sponge rubber is secured on the top surface of member 63. For some units, the members 63 and 64 may be the same density, heavier than the sponge rubber of the base. A V-shaped notch 66, with leveled ends 67, extends from front to rear of the top member 64. This notch should be some 2–4 inches across. The groove permits a user's feet to tilt into the notch. The sloped sides of the base permit the base to support side loading of a user, giving more support than vertical sides.

ADVANTAGES AND BENEFITS OF THE INVENTION

The exercise device provides a thick, foamed material which provides resistance to movement of a user's legs over a distance which greatly exceeds the movement distance of legs, feet, etc, in normal exercise on hard surfaces. For example, in jogging or running, even in walking, the feet are raised only a few inches. When not in contact with a surface, the feet (and legs) are moved through air which has negligible resistance. The thick foam pad of the invention provides a user with six or more inches of movement against the foam material. On depressing a foot, the material is depressed and the leg is under resistance during the complete depression. On raising the foot from the lowest depression point, the foam tends to resume its original shape at faster rate than the raising of the foot giving resistance while the foot is raised. This substantially increases the muscle action of the legs. Also, the thick pad permits the user to do squat jogging or running producing greater exercise than on a hard surface.

The jogging and running exercises used by many people involve outdoor activity on sidewalks, parks, running tracks, etc. These surfaces are sufficiently hard to cause a severe pounding and jostling of the user's internal organs. This has been found to be detrimental, and damage increases as the activity increases. The invention provides increased exercising with reduced shock. Of importance is the fact that exercises may be accomplished indoors, forgoing inclement weather.

The beneficial effects of cardio vascular exercises are well known. Knowledge of exercises now suggests working of legs should be done in more than one position, running sideways, backwards etc., for a more complete exercise program. Proper warmups for flexibility of hips, knees, ankles and feet are necessary. The stretching of tendons, ligaments and all other muscle groups, for over all fitness and tone are, also, beneficial.

The foam wedge allows one to combine the warming up and stretching of all muscle groups, tendons and ligaments safely with very little chance of injury. Strenuous exercises can also be done in the same safe manner without the shock of contact with hard surfaces. An exercise that will improve the flexibility of the knee is the DEEP SKI BEND, a slalom motion that slowly works down into a full squat and up again. Exercises that develop strength, are the RUNNING KNEE BENDS. Running on the foam wedge working into a full squat with toes pointing in, out, or straight ahead. Repetitious LEAPING exercises from a full squating position while grasping a stationary object. MULTI SIDED FLOOR PLANTS are done by placing the wedge in front of, behind, or on either side of you, compressing the foam with either leg, releasing slowly. An exercise that develops endurance is the EROBIC RUN. This is done by a normal running or jogging motion, working within the confines of the compressed foam wedge, without lifting feet from the surface of the foam. An exercise that affects the calf is a heel toe rocking motion that stretches the achilles tendon and works both sides of the calf. For maximum fitness, all of the afore mentioned exercises can be done up-hill or down-hill on the foam wedge with varying effects.

What is claimed is:

1. An exercise device comprising:

(a) a thick pad of resilient, flexible essentially foamed material, with a thickness of about 6–9 inches, having a lower planar surface for resting on a horizontal planar supporting surface, and an upper planar surface sloped downwardly at from 5° to 25° from the maximum thickness, (b) the front and rear sides of said pad being sloped inwardly of said pad toward said upper surface, forming said upper planar surface smaller than said lower planar surface, and (c) a top portion of resilient, flexible material being smaller than and secured on said upper planar surface with a ledge formed of said upper planar surface peripherally around said top portion, said top portion comprised of a rectangular member of resilient, flexible foamed material mounted on a rectangular base member of resilient, flexible foamed material having a center void, whereby the peripheral portions of said top portion have more resistance to compression leaving a centerwise area of less resistance.

2. An exercise device according to claim 1 wherein said rectangular member of said top portion is about 1 inch thick and said base member is about 1½ inches thick.

3. An exercise device according to claim 1, wherein said center void is rectangular and about 8 inches square.

* * * * *